US008297409B2

(12) United States Patent
Hsu et al.

(10) Patent No.: US 8,297,409 B2
(45) Date of Patent: Oct. 30, 2012

(54) COORDINATION OF MULTIPLE ELEVATOR CARS IN A HOISTWAY

(75) Inventors: Arthur C. Hsu, South Glastonbury, CT (US); Cheng-Shuo Wang, Ellington, CT (US); Hansoo Shim, Seoul (KR); Cheong Sik Shin, Seoul (KR); SeongRak Jeong, Seoul (KR); Bruce P. Lerner, Cheshire, CT (US)

(73) Assignee: Otis Elevator Company, Farmington, CT (US)

( * ) Notice: Subject to any disclaimer, the term of this patent is extended or adjusted under 35 U.S.C. 154(b) by 320 days.

(21) Appl. No.: 12/742,848

(22) PCT Filed: Nov. 30, 2007

(86) PCT No.: PCT/US2007/024628

§ 371 (c)(1), (2), (4) Date: May 13, 2010

(87) PCT Pub. No.: WO2009/070143

PCT Pub. Date: Jun. 4, 2009

(65) Prior Publication Data

US 2010/0282543 A1 Nov. 11, 2010

(51) Int. Cl.
*B66B 9/00* (2006.01)

(52) U.S. Cl. ..... 187/249; 187/382; 187/247

(58) Field of Classification Search ..... 187/247, 187/248, 249, 277, 380–388, 391–394
See application file for complete search history.

(56) References Cited

U.S. PATENT DOCUMENTS

| | | | | |
|---|---|---|---|---|
| 5,663,538 | A * | 9/1997 | Sakita | 187/382 |
| 5,865,274 | A * | 2/1999 | Kiji et al. | 187/380 |
| 5,877,462 | A | 3/1999 | Chenais | |
| 6,360,849 | B1 | 3/2002 | Hikita | |
| 6,871,727 | B2 * | 3/2005 | Jokela et al. | 187/383 |
| 7,032,716 | B2 | 4/2006 | Meyle et al. | |
| 7,621,376 | B2 * | 11/2009 | Duenser et al. | 187/249 |
| 7,819,228 | B2 * | 10/2010 | Terry et al. | 187/249 |
| 7,841,450 | B2 * | 11/2010 | Smith et al. | 187/249 |
| 8,100,230 | B2 * | 1/2012 | Smith et al. | 187/249 |
| 8,132,652 | B2 * | 3/2012 | Hakala et al. | 187/249 |
| 8,136,635 | B2 * | 3/2012 | Christy et al. | 187/249 |

(Continued)

FOREIGN PATENT DOCUMENTS

EP 1526104 B1 6/2006

(Continued)

OTHER PUBLICATIONS

Russian Office Action.

(Continued)

*Primary Examiner* — Anthony Salata
(74) *Attorney, Agent, or Firm* — Kinney & Lange, P.A.

(57) ABSTRACT

The movement of a plurality of elevator cars (12, 14) in an elevator hoistway (16) is coordinated for situations in which the regions of the hoistway that are serviceable by the cars (12, 14) at any given time are configured to overlap. A car stop plan for each elevator car (12, 14) is generated that includes a sequence of stops for servicing demand assigned to the elevator car (12, 14). Operation of the elevator cars (12, 14) is then coordinated based on the car stop plans such that each elevator car (12, 14) services its assigned demand without interfering with the car stop plans of any other of the plurality of elevator cars (12, 14).

26 Claims, 4 Drawing Sheets

U.S. PATENT DOCUMENTS

| | | | | |
|---|---|---|---|---|
| 2005/0189181 | A1 | 9/2005 | Meyle et al. | |
| 2005/0279584 | A1 | 12/2005 | Reuter et al. | |
| 2007/0039785 | A1 | 2/2007 | Smith et al. | |
| 2012/0118672 | A1* | 5/2012 | Brand | 187/247 |

FOREIGN PATENT DOCUMENTS

| | | | |
|---|---|---|---|
| EP | 1562848 | B1 | 1/2007 |
| EP | 1618059 | B1 | 1/2007 |
| JP | 2007-223765 | | 8/2000 |
| JP | 200533083 | A | 12/2005 |
| JP | 20000226164 | | 9/2007 |
| WO | W02005102893 | | 11/2005 |
| WO | WO 2006009542 | | 1/2006 |
| WO | WO 2006085846 | | 8/2006 |
| WO | WO 2006088456 | | 8/2006 |
| WO | WO 2006088457 | | 8/2006 |

OTHER PUBLICATIONS

International Search Report, mailed Jul. 25, 2008.
Korean Office Action, mailed Jun. 5, 2012.
Japanese Office Action, mailed Jun. 5, 2012.

* cited by examiner

| | |
|---|---|
| CAR 14 | L9 — L5 — L12 — L10 |
| CAR 12 | L1 — (L3) — L8 |

COORDINATION OF MULTIPLE ELEVATOR CARS IN A HOISTWAY

BACKGROUND

The present invention relates to elevator control systems. More specifically, the present invention relates to the coordination of multiple elevator cars in an elevator hoistway.

An objective in elevator system design is to minimize the required number of elevator hoistways that are deployed within the elevator system, while also trying to effectively meet the transportation needs of passengers and freight within the building. Solutions aimed at reducing the number of hoistways and improving service have included higher elevator travel speeds, shorter door opening and closing times, advanced control systems, express elevators, splitting buildings into zones, and so on. However, in buildings having a large number of stories, these measures may result in a feeling of unease when elevators accelerate, inconvenience when doors quickly close, or frustration as the result of using a complicated system, where passengers may have to change between elevator cars one or several times to get to a desired floor.

In light of the foregoing, the present invention aims to resolve one or more of the aforementioned issues that afflict conventional coordination of multiple cars.

SUMMARY

The present invention relates to coordinating movement of a plurality of elevator cars in an elevator hoistway in situations in which the regions of the hoistway that are serviceable by the cars at any given time are configured to overlap. A car stop plan for each elevator car is generated that includes a sequence of stops for servicing demand assigned to the elevator car. Operation of the elevator cars is then coordinated based on the car stop plans such that each elevator car services its assigned demand without interfering with the car stop plans of any other of the plurality of elevator cars.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
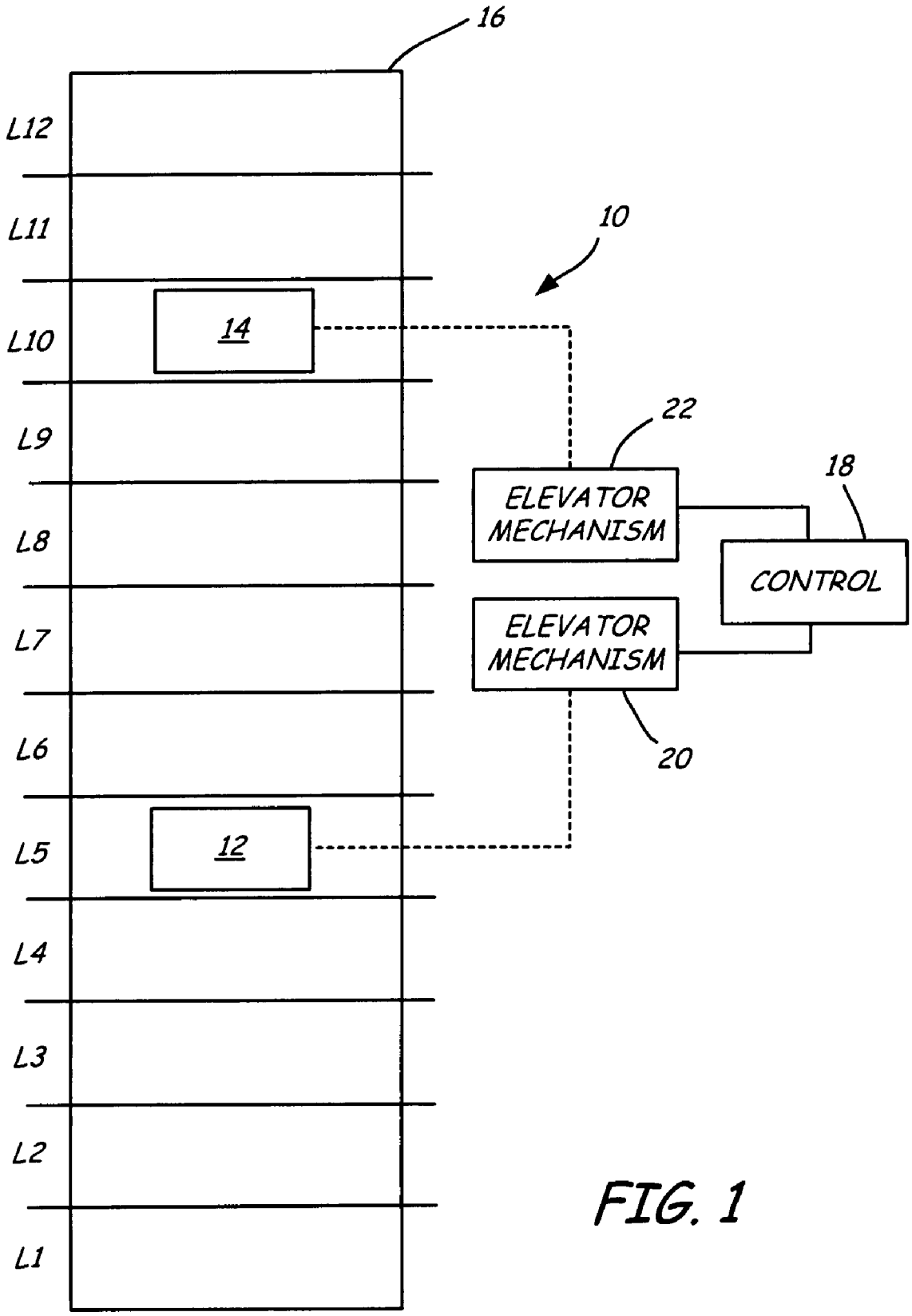
FIG. 1 is a schematic view of an embodiment of an elevator system including multiple independently controllable elevator cars in a hoistway.

Efforts have been made throughout the drawings to use the same or similar reference numerals for the same or like components.

FIG. 1 is a schematic view of elevator system 10 including first elevator car 12 and second elevator car 14 vertically disposed with respect to each other in hoistway 16. In this example, hoistway 16 is located in a building having twelve floors including floor levels L1-L12 and is configured to allow first elevator car 12 and second elevator car 14 to service passenger demands on most or all of the floors. Controller 18 is connected to first elevator mechanism 20 and second elevator mechanism 22. First elevator mechanism 20 includes the mechanical assembly for operation of first elevator car 12, and second elevator mechanism 22 includes the mechanical assembly for operation of second elevator car 14.

Hoistway 16 may be configured such that elevator car 12 services all but the uppermost floor that is inaccessible due to the presence of elevator car 14, and such that elevator car 14 services all but the lowermost floor that is inaccessible due to the presence of elevator car 12. Alternatively, hoistway 16 may include a parking area below level L1 such that elevator car 12 may be temporarily parked to allow elevator car 14 to service requests to level L1. Similarly, hoistway 16 may include a parking area above level L12 such that elevator car 14 may be temporarily parked to allow elevator car 12 to access level L12. It should be noted that while twelve levels L1-L12 are shown, elevator system 10 may be adapted for use in a building including any number of floors. In addition, while two vertically disposed elevator cars 12 and 14 are shown, hoistway 16 may include any number of elevator cars operable to service most or all of the floors in the building.

Elevator cars 12 and 14 are independently controlled by controller 18 (via elevator mechanisms 20 and 22, respectively) based on demands for load transport received on call devices on floors L1-L12. Controller 18 receives service requests from passengers on levels L1-L12 and controls elevator cars 12 and 14 to efficiently and safely transport the passengers to their respective destination floors. Controller 18 monitors and controls the location, speed, and acceleration of each of elevator cars 12 and 14 while elevator cars 12 and 14 are servicing passenger transportation requests. In some embodiments, controller 18 determines the location and speed of elevator cars 12 and 14 based on the data provided to controller 18 by position and speed sensors in elevator mechanisms 20 and 22, respectively.

In order to provide safe and efficient operation of elevator cars 12 and 14, controller 18 coordinates the relative movement between elevator cars 12 and 14 based on a variety of considerations. For example, controller 18 assures that elevator cars 12 and 14 are separated by at least a separation distance or margin to avoid interference between elevator cars 12 and 14 while servicing their respective passenger demands. In addition, controller 18 moves elevator cars 12 and 14 in the direction of the destinations of boarded passengers (rather than away from passenger destinations). Furthermore, controller 18 prevents a deadlock between elevator cars 12 and 14. A deadlock may be an undesirable situation in which the assigned destination of lower elevator car 12 is above upper elevator car 14 while the assigned destination of upper elevator car 14 is below lower elevator car 12. A deadlock may also occur when the distance between the assigned destination of one of elevator cars 12, 14 and the position of the other of elevator cars 12, 14 is less than the separation distance. In either case, in order to resolve the deadlock, one of elevator cars 12, 14 would be forced to move in the direction opposite its assigned destination so as to allow the other elevator car 12, 14 to move towards its assigned destination.

Controller 18 first generates a car stop plan for each of elevator cars 12 and 14. Each stop in the car stop plan represents a position in hoistway 16 at which elevator car 12 or 14 stops. For example, elevator cars 12 and 14 may stop to service passenger demand by picking up a passenger or dropping off a passenger, or to park in a position most conducive to serving future demand. The car stop plan for elevator car 12 or 14 represents the sequence of stops that elevator car 12 or 14 makes to service all demand assigned to elevator car 12 or 14. In some embodiments, controller 18 generates multiple car stop plans for each of elevator cars 12 and 14 that provide alternative sequences of stops that service the demand assigned to that car.

Figure 2:
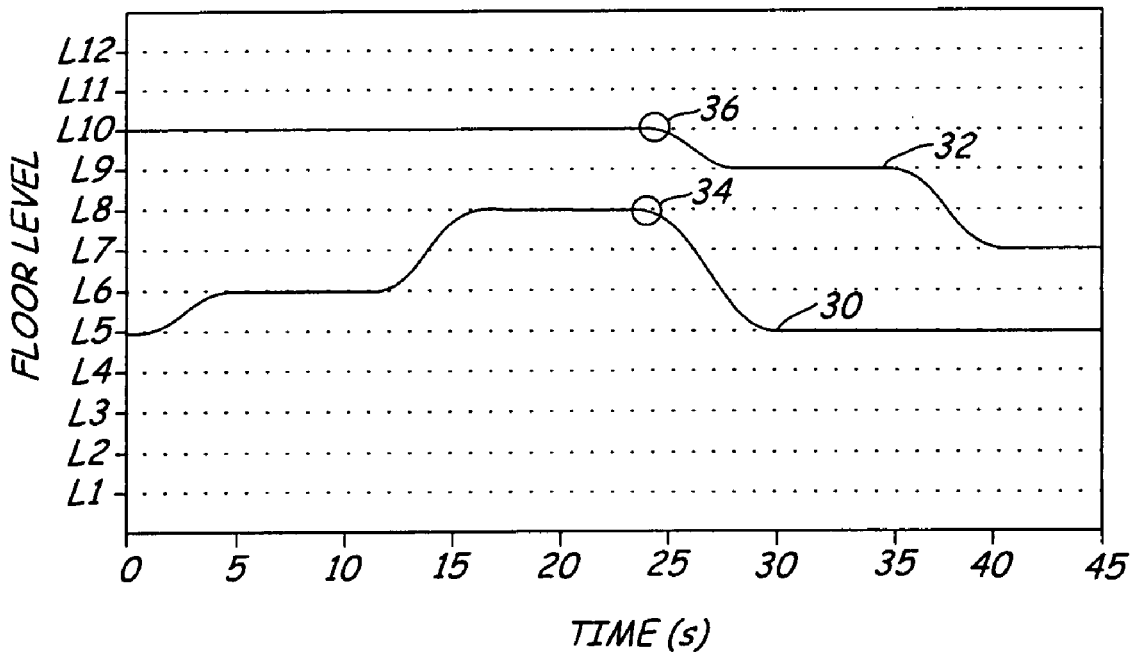
FIG. 2 is a graph showing the position versus time of the elevator cars in the hoistway of FIG. 1.
Figure 3:
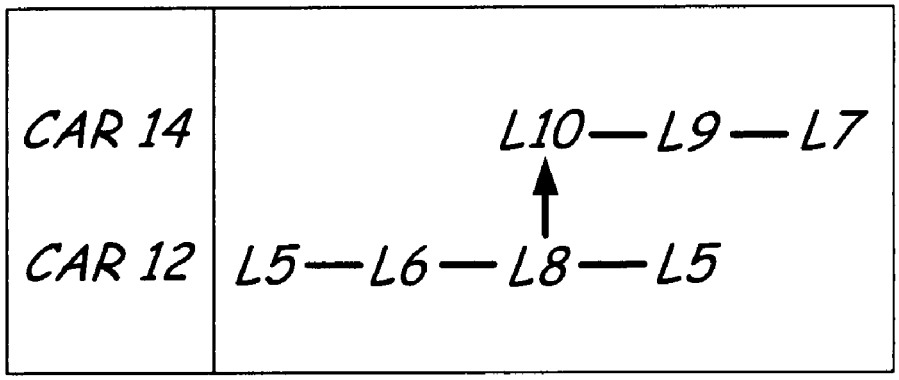
FIG. 3 is a plan view of a hoistway plan that governs coordination of the elevator cars to provide the response illustrated in FIG. 2.

Controller 18 then generates a hoistway plan that consists of a car stop plan for each of elevator cars 12 and 14, as well as elevator car coordination information. The coordination information may include additional stops in the car stop plans and/or a set of precedence relationships, each of which relates a stop in the car stop plan of one of elevator cars 12 and 14 with a stop in the car stop plan of the other of elevator cars 12 and 14. As an example, FIG. 2 is a graph showing the coordination of elevator cars 12 and 14 in hoistway 16 as a function of time, and FIG. 3 is a plan view of the hoistway plan that governs coordination of elevator cars 12 and 14. In FIG. 2, the position of elevator car 12 is plotted as line 30 and the position of elevator car 14 is plotted as line 32. Elevator cars 12 and 14 are initially positioned as shown in FIG. 1, with elevator car 12 on floor level L5 and elevator car 14 on floor level L10. The car stop plan for elevator car 12 includes a stop at floor level L6 for picking up a passenger, followed by stop at floor level L8 for dropping off the passenger. The car stop plan for elevator car 14 includes a stop at floor L9 for picking up a passenger, followed by a stop at floor level L7 for dropping off the passenger.

To prevent a deadlock between elevator cars 12 and 14, controller 18 may give priority to elevator car 12 to serve its stops at floor levels L6 and L8 before elevator car 14 serves floor levels L9 and L7. Controller 18 may give priority to elevator car 12 by extending the duration of the stop of elevator car 14 on floor level L10. Accordingly, controller 18 provides a hoistway plan as illustrated in FIG. 3 that includes the car stop plans for the two elevator cars, as well as a precedence relationship providing that the departure of elevator car 12 from floor level L8 precedes the departure of elevator car 14 from floor level L10 (represented by the arrow extending from the stop of elevator car 12 at floor level L8 to the stop of elevator car 14 at floor level L10). In this example, the hoistway plan includes one precedence relationship, but it will be appreciated that the hoistway plan may include any number of precedence relationships. In FIG. 2, the departure of elevator car 12 from floor level L8 is noted by point 34 on line 30, while the departure of elevator car 14 from floor level L10 is noted by point 36 on line 32. Based on the example illustrated, point 34 occurs no later in time than point 36.

The hoistway plan may be executed by controller 18 in multiple ways. In one approach, precedence relationships are enforced in the hoistway, each of which provides an order of movement of elevator cars 12 and 14. In the example hoistway plan described above with regard to FIG. 2, the precedence relationship provides that the departure of elevator car 12 from floor level L8 precedes the departure of elevator car 14 from floor level 10. Thus, to enforce the precedence relationship, controller 18 does not activate elevator car 14 to move from floor level L10 to floor level L9 until after it has committed to move elevator car 12 from floor level L8 to floor level L5. In this case, the duration of the stop of elevator car 14 at floor level L10 may be extended.

In another approach to executing the hoistway plan, a schedule is generated for movement of each of elevator cars 12 and 14. The hoistway plan is coordinated as a function of the timing of movement of elevator cars 12 and 14. For example, in FIG. 2, the schedule for the departure time of elevator car 12 from floor level L8 (point 34) occurs at a time earlier than or at the same time as the departure time of elevator car 14 from floor level L10 (point 36). The hoistway plan may be augmented with timing information that schedules the time that controller 18 may initiate movement to each stop in the car stop plans for elevator cars 12 and 14. If the realization of events in the hoistway does not follow the schedule (such as, for example, if a passenger holds the doors of the elevator open for a prolonged period of time to allow loading of a large group of passengers), the timing of all future movement initiations may be adjusted accordingly.

Controller 18 also coordinates operation of elevator cars 12 and 14 to assure that they always remain separated by at least the separation distance. The separation distance may be, for example, a number of floor levels (e.g., one or two floor levels) or a specific distance (e.g., 5 m). In the example illustrated in FIG. 2, the separation distance maintained by controller 18 is two floor levels. The separation distance is maintained by observing the precedence relationship, whereby controller 18 delays the departure of elevator car 14 from floor level L10 until elevator car 12 begins traveling from floor level L8. After elevator car 12 begins to move to floor level L5, elevator car 14 may begin traveling toward its stop at floor level L9.

In order to allow elevator car 14 to make its assigned stop at floor level L7, the hoistway plan may include an additional stop for elevator car 12 to move to floor level L5. This added stop for the elevator car 12 may be referred to as a yield stop since it moves elevator car 12 to a position that allows elevator car 14 to reach a stop in its car stop plan. Yield stops are required stops that are added to a car stop plan when the hoistway plan is generated (i.e., yield stops are not included in the individual car stop plans), and are incorporated as necessary to maintain the separation distance between elevator cars 12 and 14 when the hoistway plan is executed. In the case that a car has a yield stop that is not the last stop in that car's car stop plan, a precedence relationship exists between a stop in the car stop plan of an adjacent car and the yield stop. This precedence relationship provides that the departure of the adjacent car from a particular stop precedes the departure of the car from the yield stop.

The separation distance may also be maintained by including conditional stops in the hoistway plan. Similar to yield stops, conditional stops are stops that are added to a car stop plan when the hoistway plan is generated, and are incorporated as necessary to maintain the separation distance between elevator cars 12 and 14 when the hoistway plan is executed. There is a precedence relationship associated with every conditional stop that ensures that one car does not proceed to the next stop after the conditional stop until the other, adjacent car has departed a particular stop. Thus, one car may need to stop at the conditional stop and wait if the other, adjacent car has not reached or has not departed from the particular stop in the precedence relationship. However, a car does not need to stop at a conditional stop if the precedence relationship is already satisfied, which occurs when the adjacent car has already reached and departed from the particular stop in the precedence relationship.

Figures 4, 5:
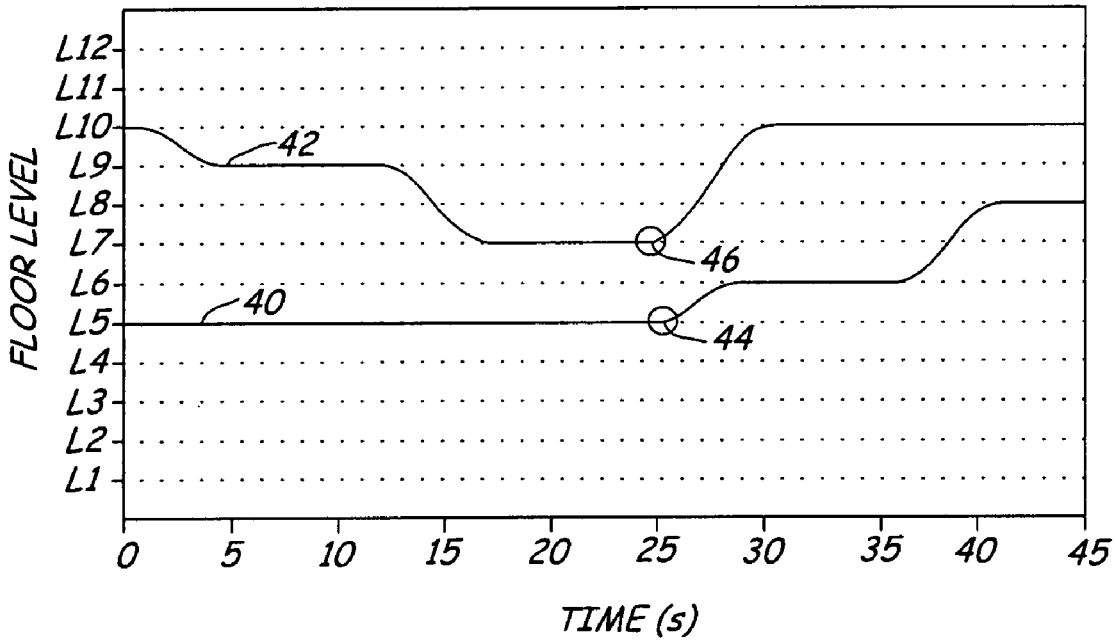
FIG. 4 is a plan view of a hoistway plan that includes conditional stops.
FIG. 5 is a graph showing the position versus time of the elevator cars in FIG. 1, governed by an alternate hoistway plan.

To illustrate, FIG. 4 is a plan view of a hoistway plan that includes a conditional stop. In this hoistway plan, elevator car 12 starts at floor level L1 and includes a stop at floor level L8. The car stop plan for elevator car 14 starts at floor level L9 and includes subsequent stops at floor levels L5, L12, and L10. In this example, a separation distance of two stories is employed, i.e., the two cars 12, 14 are to remain at least two stories apart at all times.

In order to assure that elevator cars 12 and 14 remain separated by the separation distance at all times and to avoid deadlock, the hoistway plan of FIG. 4 includes a conditional stop for elevator car 12 at floor level L3 (denoted by parentheses in FIG. 4). To explain, if elevator car 12 is ready to depart floor level L1 for floor level L8, but elevator car 14 is (a) still at floor level L9, (b) en route to floor level L5, or (c) stopped at floor level L5, then elevator car 12 stops at the conditional stop location at floor level L3. Elevator car 12 waits at floor level L3 until elevator car 14 departs floor level L5 toward floor level L12. The arrow extending from floor level L5 in the car stop plan for elevator car 14 toward the conditional stop at floor level L3 in the car stop plan for elevator car 12 denotes this precedence relationship (i.e., elevator car 14 must leave floor level L5 before elevator car 12 can leave floor level L3). On the other hand, if elevator car 14 has serviced its stop at floor level L5 and has begun moving toward its next stop at floor level L12 by the time elevator car 12 reaches floor level L3, then elevator car 12 is not required to stop at floor level L3.

For each set of car stop plans, controller 18 may generate multiple alternative hoistway plans that each service the demand assigned to elevator cars 12 and 14. For example, in addition to the example described with regard to FIGS. 2 and 3, controller 18 may alternatively coordinate elevator cars 12 and 14 by giving priority to elevator car 14 to serve its stops at floor levels L9 and L7 before elevator car 12 serves its stops at floor levels L6 and L8. FIG. 5 is a graph showing an alternative coordination of elevator cars 12 and 14 in hoistway 16 as a function of time, wherein the hoistway plan includes a precedence relationship specifying that the departure of elevator car 14 from floor level L7 precedes the departure of elevator car 12 from floor level L5. The position of elevator car 12 is plotted as line 40 and the position of elevator car 14 is plotted as line 42. The departure of elevator car 12 from floor level L5 is noted by point 44 on line 40 and the departure of elevator car 14 from floor level L7 is noted by point 46 on line 42. Based on the example illustrated, point 44 occurs no earlier in time than point 46.

In order to allow elevator car 12 to make its assigned stop at floor levels L6 and L8, a yield stop may be added to the hoistway plan for elevator car 14 to move to floor level L10. Controller 18 coordinates elevator cars 12 and 14 by delaying activation of elevator car 12 to move to floor L6 until after controller 18 has committed to move elevator car 14 from floor level L7 to the yield stop at floor level L10. Alternatively, a schedule may be generated in which the departure time of elevator car 14 from floor level L7 (point 46) occurs at a time no later than the departure time of elevator car 12 from floor level L5 (point 44).

It should be noted that the hoistway plans described are merely exemplary, and many hoistway plans that serve the stops in the car stop plans for elevator cars 12 and 14 are possible. In addition, if controller 18 generates multiple car stop plans for each of elevator cars 12 and 14, the number of possible alternative hoistway plans further increases.

In the event that controller 18 generates multiple hoistway plans, controller 18 may apply a ranking or scoring function to the multiple hoistway plans to determine the best performing hoistway plan. In order to make this determination, controller 18 may take into consideration information related to the operation and efficiency of operation of elevator system 10. For example, to rank or score each hoistway plan, controller 18 may consider the predicted waiting time for passengers assigned to elevator cars 12 and 14 (based on estimated loading and unloading times), the number of extra coordination stops (i.e., stops that do not service passenger demand) for elevator cars 12 and 14 in each hoistway plan, and the amount of delay introduced at each stop. The information considered in ranking or scoring the hoistway plans (and the importance of each category of information in preparing the ranking or scoring) may be programmed in controller 18. When controller 18 determines the highest or most favorably ranked or scored hoistway plan based on the programmed considerations, controller 18 selects and executes that highest or most favorably ranked or scored hoistway plan.

The car stop plans for elevator cars 12 and 14 are dynamic in that controller 18 may update the car stop plans. For example, a car stop plan may be updated if demand assigned to elevator car 12 or 14 changes, or if the status or operation of elevator car 12 or 14 changes (e.g., one of elevator cars 12 and 14 become unavailable for service). In the example above, if elevator car 12 is assigned to pick up a passenger at floor level L7 after its stop at floor level L8, and to drop off that same passenger at floor level L6, these additional two stops may be incorporated into the car stop plan for elevator car 12 between its stop on floor levels L8 and the yield stop on floor level L5. When any of the car stop plans are updated, controller 18 may generate one or more new hoistway plans based on the updated car stop plans. Alternatively, controller 18 may generate new hoistway plans periodically (e.g., every 10 ms), regardless of changes in passenger demand. In any case, controller 18 may then rank each of the new hoistway plans based on the ranking or scoring function described above, and subsequently execute the highest or most favorably ranked or scored new hoistway plan.

Figure 6:
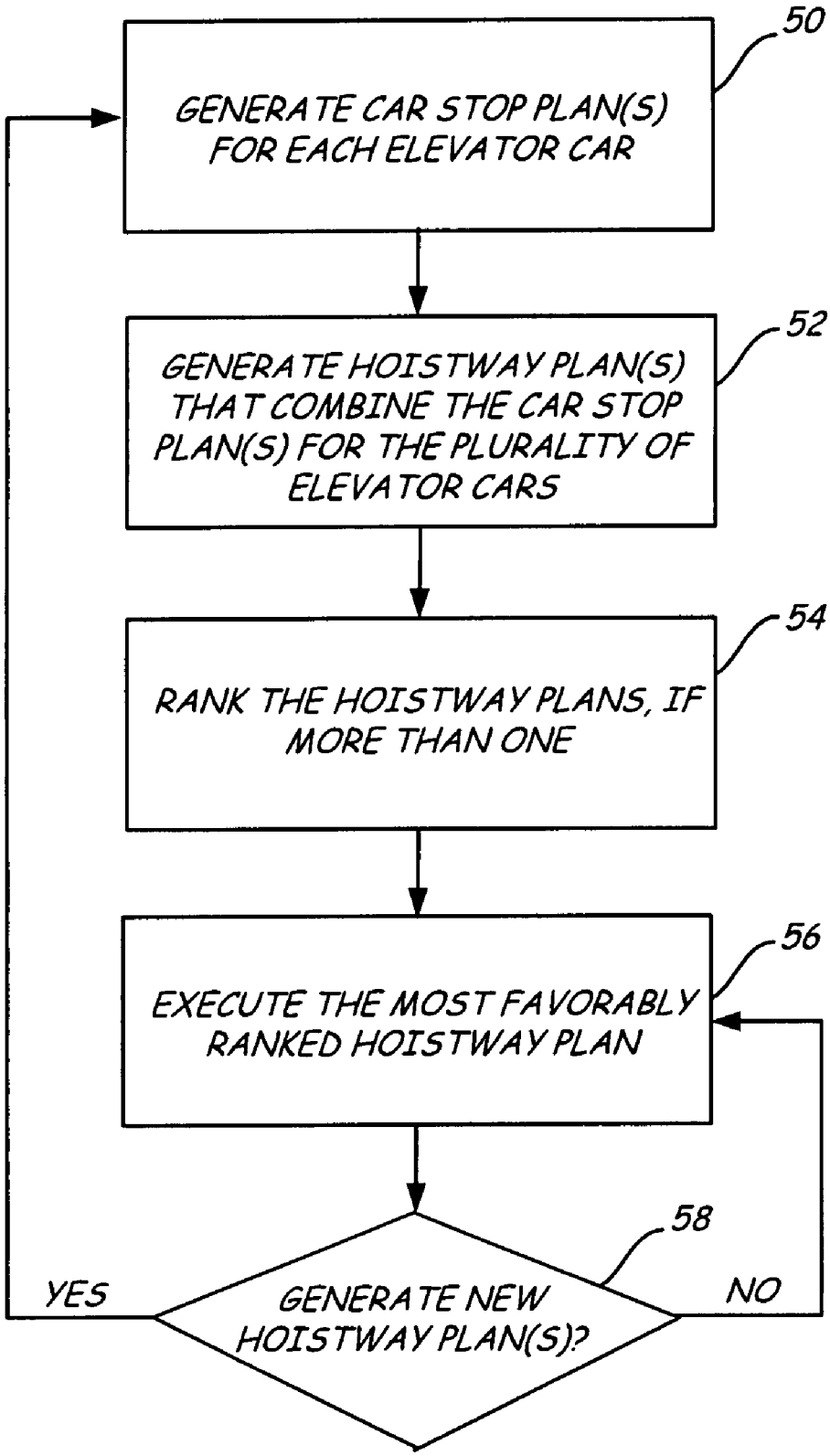
FIG. 6 is a flow diagram of a process for coordinating movement between the multiple elevator cars in a hoistway.

FIG. 6 is a flow diagram of the process for coordinating movement between elevator cars 12 and 14 in hoistway 16. Initially, in step 50, controller 18 generates car stop plans for each of elevator cars 12 and 14 in hoistway 16. When the car stop plans for elevator cars 12 and 14 have been generated, controller 18 then, in step 52, generates hoistway plans that coordinate the car stop plans for the elevator cars 12 and 14. Each hoistway plan is generated so that each of elevator cars 12 and 14 services its assigned demand without interference with the car stop plan of the other of elevator cars 12 and 14. The coordination may be achieved by deciding and enforcing precedence relationships or by creating and following a schedule. Controller 18 then calculates the predicted time that each car arrives at and departs from each of the stops and considers the impact of passenger delays as they wait for the car to arrive, wait for a stopped car to begin moving, or wait for the car to reach their destinations. Based on these calculations or other criteria, in step 54 controller 18 ranks or scores the hoistway plans to determine the best performing hoistway plan. Then, in step 56, the controller selects and executes the highest or most favorably ranked hoistway plan. As the coordination is dynamic, the controller 18 then determines, in decision step 58, whether a new hoistway plan or plans should be generated. New hoistway plans may be generated, for example, as a result of any changes in passenger demand that have occurred relative to either (or both) of elevator cars 12 and 14, or at periodic intervals programmed in controller 18. If no new hoistway plans are to be generated by controller 18, the process returns to the optimum hoistway plan being executed in step 56. If, however, new hoistway plans are to be generated by controller 18 in decision step 58, the process returns to step 50.

The present invention relates, to coordinating movement of a plurality of elevator cars in an elevator hoistway. A car stop plan for each elevator car is generated that includes a sequence of stops for servicing demand assigned to the elevator car. Operation of the elevator cars is then coordinated based on the car stop plans such that each elevator car services its assigned demand without interfering with the car stop plans of any other of the plurality of elevator cars. In some embodiments, one or more hoistway plans are generated, and each of the one or more hoistway plans is ranked based on predicted performance with regard to servicing the demand assigned to the plurality of elevator cars. The highest or most favorably ranked hoistway plan is then executed. By coordinating multiple elevator cars in a hoistway in this way, each elevator car safely and efficiently services its demand without interfering with the operation of the other elevator car or cars in the hoistway. In addition, the hoistway plan or plans may be updated as demand for each elevator car changes, which allows for continuous safe and efficient operation of the elevator cars.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. A method for coordinating movement of a plurality of elevator cars in an elevator hoistway wherein the regions of the hoistway that are serviceable by the cars at any given time are configured to overlap, the method comprising:

generating a car stop plan for each elevator car that includes a sequence of stops for servicing demand assigned to the elevator car; and coordinating operation of the elevator cars based on the car stop plans such that each elevator car services its assigned demand without interfering with the car stop plans of any other of the plurality of elevator cars;

generating multiple hoistway plans that each combine the car stop plans for the plurality of elevator cars in a way that each elevator car services its assigned demand without interfering with the car stop plans of any other of the plurality of elevator cars;

ranking each of the multiple hoistway plans based on predicted performance with regard to servicing the demand assigned to the plurality of elevator cars; and selecting a hoistway plan for execution based upon the ranking; and executing the selected hoistway plan.

2. The method of claim 1, wherein coordinating operation of the elevator cars comprises:

generating a schedule based on the sequence of stops in each car stop plan that prevents interference between the car stop plans of the plurality of elevator cars.

3. The method of claim 1, wherein coordinating operation of the elevator cars comprises:

establishing a precedence relationship between two elevator cars that prioritizes a departure of one of the two elevator cars from its stop relative to a departure of the other of the two elevator cars from its stop.

4. The method of claim 1, wherein coordinating operation of the elevator cars comprises:

maintaining a separation distance between adjacent elevator cars in the elevator hoistway.

5. The method of claim 4, wherein the step of generating a car stop plan for each elevator car comprises:

providing a conditional stop location in the car stop plan of an elevator car such that the elevator car stops at the conditional stop location only if necessary to maintain the separation distance from an adjacent elevator car.

6. The method of claim 4, wherein the step of generating a car stop plan for each elevator car includes:

providing a yield stop location for one of the elevator cars such that the elevator car stops at the yield stop location to maintain the separation distance from an adjacent elevator car.

7. The method of claim 6, wherein the step of providing a yield stop includes:

moving one car in a direction away from the other car so as to achieve the separation distance.

8. The method of claim 1, wherein generating a car stop plan for each elevator car comprises updating the car stop plan for each elevator car in response to a change in elevator car demand or status.

9. The method of claim 1, wherein generating a car stop plan for each elevator car comprises updating the car stop plan for each elevator car periodically.

10. An elevator system comprising:

a plurality of elevator cars in an elevator hoistway; and a controller configured to generate a car stop plan for each elevator car that includes a sequence of stops for servicing demand assigned to the elevator car, generate multiple hoistway plans that each combine the car stop plans for the plurality of elevator cars in a way that each elevator car services its assigned demand without interfering with any other of the plurality of elevator cars, and control operation of elevator cars based upon the hoistway plan, rank each of the multiple hoistway plans based on predicted performance with regard to servicing the demand assigned to the plurality of elevator cars, and execute a highest ranked hoistway plan of the one or more hoistway plans.

11. The elevator system of claim 10, wherein the regions of the hoistway that are serviceable by the cars at any given time are configured to overlap.

12. The elevator system of claim 10, wherein the controller is further configured to generate a schedule based on the sequence of stops in each car stop plan that prevents interference between the car stop plans of the plurality of elevator cars.

13. The elevator system of claim 10, wherein the controller is further configured to establish a precedence relationship between two elevator cars that prioritizes a stop in the sequence of stops for one of the two elevator cars relative to a stop in the sequence of stops for the other of the two elevator cars.

14. The elevator system of claim 10, wherein the controller is further configured to maintain a separation distance between adjacent elevator cars in the elevator hoistway.

15. The elevator system of claim 14, wherein the car stop plan of one or more of the cars includes a conditional stop location at which the elevator car is configured to stop only if necessary to maintain a separation distance from an adjacent elevator car.

16. The elevator system of claim 14, wherein the car stop plan of one or more of the cars includes a yield stop location for one of the elevator cars such that the elevator car stops at the yield stop location to maintain the separation distance from an adjacent elevator car.

17. The elevator system of claim 10, wherein the controller is further configured to update the car stop plan for each elevator car and generate a new hoistway plan in response to a change in elevator car demand or status.

18. The elevator system of claim 10, wherein the controller is further configured to generate a new hoistway plan periodically.

19. A method for controlling a plurality of elevator cars in an elevator hoistway, the method comprising:

generating one or more car stop plans for each elevator car, wherein each car stop plan includes a sequence of stops that services all demand assigned to the elevator car;

generating one or more hoistway plans that combine the one or more car stop plans for each of the plurality of elevator cars in a way that each elevator car services its assigned demand without interfering with the car stop plans of any other of the plurality of elevator cars;

ranking each of the one or more hoistway plans based on predicted performance with regard to servicing all demand assigned to the plurality of elevator cars; and executing a highest ranked hoistway plan of the one or more hoistway plans.

20. The method of claim 19, wherein the regions of the hoistway that are serviceable by the cars at any given time are configured to overlap.

21. The method of claim 19, wherein generating one or more hoistway plans comprises:

establishing a precedence relationship between two elevator cars that prioritizes a stop in the sequence of stops for one of the two elevator cars relative to a stop in the sequence of stops for the other of the two elevator cars.

22. The method of claim 19, wherein generating one or more car stop plans for each elevator car comprises:

updating the one or more car stop plans for each elevator car in response to a change in elevator car demand or status; and generating one or more new hoistway plans based on the updated one or more car stop plans for each elevator car.

23. The method of claim 19, wherein generating one or more hoistway plans comprises:

generating, periodically, one or more new hoistway plans.

24. The method of claim 19, wherein the step of generating one or more car stop plans for each elevator car comprises:

providing a conditional stop location in the car stop plan of an elevator car such that the elevator car stops at the conditional stop location only if necessary to maintain the separation distance from an adjacent elevator car.

25. The method of claim 19, wherein the step of generating a car stop plan for each elevator car includes:

providing a yield stop location for one of the elevator cars such that the elevator car stops at the yield stop location to maintain the separation distance from an adjacent elevator car.

26. The method of claim 25, wherein the step of providing a yield stop comprises:

moving one car in a direction away from the other car so as to achieve the separation distance.

* * * * *

UNITED STATES PATENT AND TRADEMARK OFFICE

CERTIFICATE OF CORRECTION

PATENT NO. : 8,297,409 B2
APPLICATION NO. : 12/742848
DATED : October 30, 2012
INVENTOR(S) : Arthur C. Hsu et al.

It is certified that error appears in the above-identified patent and that said Letters Patent is hereby corrected as shown below:

Col. 7, Line 52
Delete "and"

Signed and Sealed this
Twenty-second Day of January, 2013

David J. Kappos

David J. Kappos
*Director of the United States Patent and Trademark Office*